US006276654B1

(12) United States Patent
Perkins

(10) Patent No.: US 6,276,654 B1
(45) Date of Patent: Aug. 21, 2001

(54) WALL PANEL MOUNT

(76) Inventor: Thomas Allen Perkins, 6838 S. 350 E., Lafayette, IN (US) 47905

( * ) Notice: Subject to any disclaimer, the term of this patent is extended or adjusted under 35 U.S.C. 154(b) by 0 days.

(21) Appl. No.: 09/436,748

(22) Filed: Nov. 9, 1999

Related U.S. Application Data

(63) Continuation of application No. 08/998,883, filed on Dec. 29, 1997, now abandoned.

(51) Int. Cl.[7] ..... A47G 29/00

(52) U.S. Cl. ..... 248/694; 248/250; 248/309.1; 248/205.1; 52/27; 52/506.01; 52/506.06

(58) Field of Search ..... 248/205.1, 236, 248/235, 309.1, 544, 201, 250, 694; 52/27, 506.01, 506.06, 508, 551, 552, 730.7, 730.1, 731.1, 733.2, 733.3, 79.9, 79.12

(56) References Cited

U.S. PATENT DOCUMENTS

| | | | |
|---|---|---|---|
| D. 362,173 | 9/1995 | Skitromo | D8/350 |
| 4,229,916 | 10/1980 | White | 52/98 |
| 4,875,650 | 10/1989 | Goodell | 248/261 |
| 4,920,708 | 5/1990 | MacLeod et al. | 52/60 |
| 5,000,409 | 3/1991 | MacLeod et al. | 248/205 |
| 5,275,366 | 1/1994 | Simmons | 248/205.1 |
| 5,397,093 | 3/1995 | Chubb et al. | 248/544 |
| 5,549,266 | 8/1996 | Mitchell et al. | 248/205.1 |
| 5,577,702 | 11/1996 | Chubb et al. | 248/544 |
| 5,657,606 | 8/1997 | Ressel et al. | 52/690 |
| 5,775,032 | 7/1998 | Lacy | 52/28 |

*Primary Examiner*—Leslie A. Braun
*Assistant Examiner*—A. Joseph Wujciak
(74) *Attorney, Agent, or Firm*—Woodard, Emhardt, Naughton, Moriarty & McNett

(57) ABSTRACT

A wall panel mount for mounting a wall panel to siding on a wall of a building. The wall panel mount includes a first side surface having an indentation adapted to mate with the siding, and an abutment adapted to flush against the wall. The wall panel further includes either a second side surface bordering the first side surface, and a third side surface bordering the second side surface and the first side surface, or a second side surface bordering the first side surface, a third side surface bordering the second side surface, and a fourth side surface bordering the first side surface and the third side surface. The wall panel is to be adjoined to the third side surface or to be securely inserted into a groove of a channel that is adjoined to the third side surface.

20 Claims, 5 Drawing Sheets

WALL PANEL MOUNT

CROSS REFERENCE TO RELATED APPLICATIONS

The present application is a continuation of U.S. patent application Ser. No. 08/998,883, filed Dec. 29, 1997 now abandoned.

FIELD OF THE INVENTION

The present invention generally relates to devices for mounting various articles to a building, and more particularly to a device for mounting a wall panel to a siding of a home.

BACKGROUND OF THE INVENTION

Presently, the installation of an extended room on the siding of a home requires a channel over the siding in order to provide a smooth surface to mount a wall panel to the siding. Typically, the channel is U-shaped defining a groove to engage the wall panel, and having a vertical side surface opposing the groove. Sponge rubber is normally utilized to seal the vertical side surface of the channel to the siding. Unfortunately, sponge rubber does not properly fill gaps between the vertical side surface of the channel and the butt joints of the siding. Consequently, wall panels mounted to the siding via the channel may not be stable. In addition, the appearance of the extended room may not be pleasing. What is therefore needed is a device that stably and aesthetically mounts a wall panel to siding.

SUMMARY OF THE INVENTION

The present invention overcomes the aforementioned drawbacks associated with the present method of mounting one or more wall panels to siding. Various aspects of the present invention are novel, non-obvious, and provide various advantages. While the actual nature of the present invention described in detail herein can only be determined with reference to the claims appended hereto, certain features which are characteristic of the present invention disclosed herein can be described briefly.

In accordance with a first aspect of the present invention, a wall panel mount for mounting a wall panel to a siding panel affixed to a wall of a building comprises a first side surface having an indentation to mate with the siding panel. The wall panel mount further comprises a second side surface bordering the first side surface and a third side surface bordering the second side surface. The wall panel is to be adjoined to the third side surface.

In accordance with a second aspect of the present invention, a wall panel mount for mounting a wall panel to a siding panel affixed to a wall of a building comprises a first side surface having an indentation to mate with the siding panel, a second side surface bordering the first side surface and a third side surface bordering the second side surface. The wall panel mount further comprises a channel having a groove and adjoined to the third side surface. The wall panel is to be securely inserted into the groove of the channel.

An object of the present invention is to provide a stable and aesthetic mount of a wall panel to one or more siding panels affixed to a wall of a building.

These and other objects of the present invention will become more apparent from the following description of the preferred embodiments of the present invention.

DESCRIPTION OF THE PREFERRED EMBODIMENTS

Figure 1A:
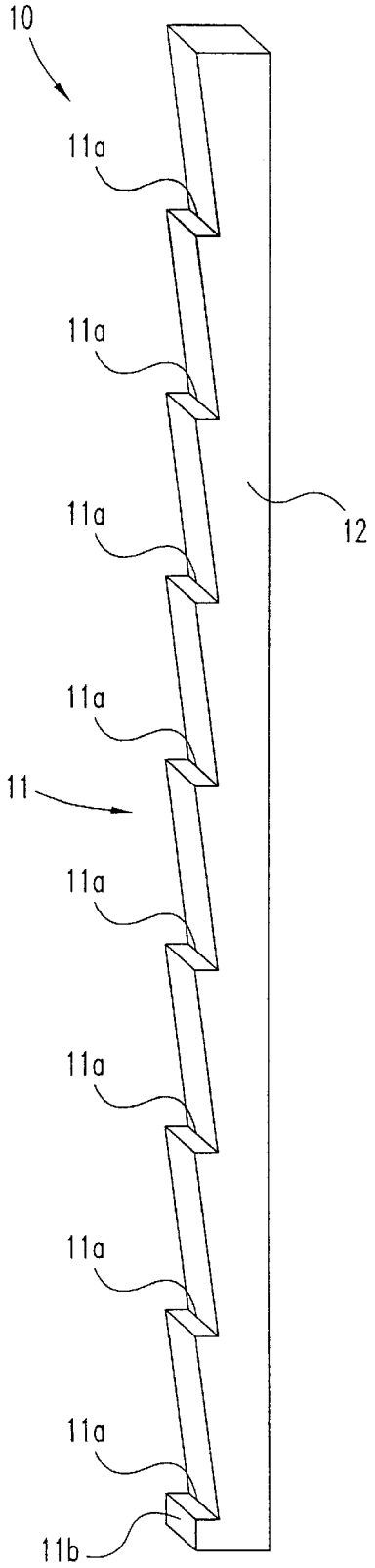
FIG. 1A is a front perspective view of a first preferred embodiment of a wall panel mount in accordance with the present invention.

For the purposes of promoting an understanding of the principles of the present invention, reference will now be made to the preferred embodiments illustrated in the drawings and specific language will be used to describe the same. It will nevertheless be understood that no limitation of the scope of the present invention is thereby intended, such alterations and further modifications in the illustrated embodiments, and such further applications of the principles of the present invention as illustrated therein being contemplated as would normally occur to one skilled in the art to which the present invention relates.

Figure 1B:
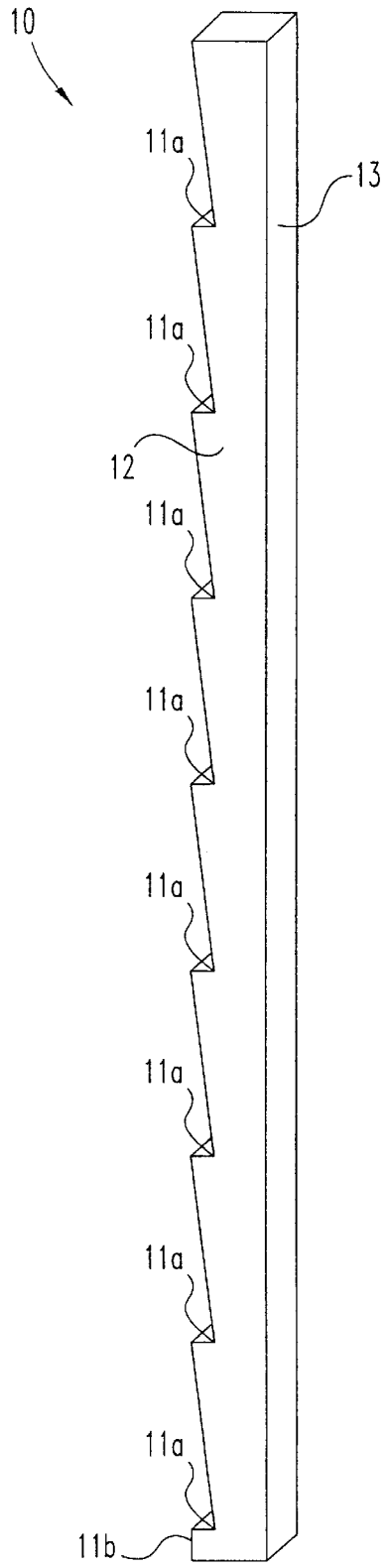
FIG. 1B is a rear perspective view of the wall panel mount of FIG. 1A.

FIGS. 1A and 1B are a front perspective view and a rear perspective view, respectively, of a wall panel mount 10 in accordance with the present invention. Referring to FIGS. 1A and 1B, wall panel mount 10 is substantially a square prism comprising a first side surface 11, a second side surface 12 bordering first side surface 11, a third side surface 13 bordering second side surface 12 and diametrically opposing first side surface 11, and a fourth side surface 14 (not shown) bordering first side surface 11 and third side surface 13, and diametrically opposing second side surface 12. First side surface 11 has a plurality of indentations 11*a* to mate with siding panels affixed to a wall of a building, and an abutment 11*b* to flush against an exposed lower portion of the wall. Second side surface 12, third side surface 13 and fourth side surface 14 are substantially vertical surfaces. The present invention contemplates that wall panel mount 10 can be made from any material, or any combination of materials, including, for examples, wood, metal or plastic with an optional sealing layer (not shown) such as rubber or foam on either first side surface 11, third side surface 13, or both. The present invention further contemplates that wall panel mount 10 can be solid or hollow, and that wall panel mount 10 can consist of separate pieces (not shown) that are assembled to construct wall panel mount 10.

Figure 2:
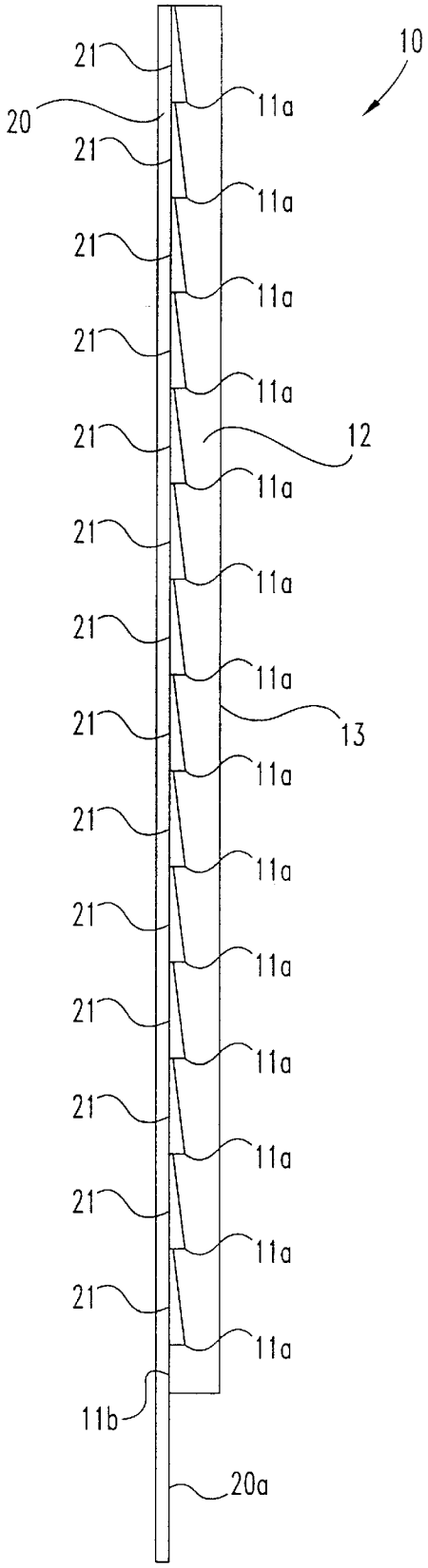
FIG. 2 is a side view of the wall panel mount of FIG. 1A affixed to siding panels on a wall.

FIG. 2 is a side view of indentations 11*a* mated to a plurality of siding panels 21 affixed to a wall 20, and abutment 11*b* flushed against an exposed lower portion 20*a* of wall 20. Referring to FIG. 2, for illustrative purposes, siding panels 21 are configured as right triangles, and exposed lower portion 20*a* of wall 20 is substantially vertical. However, it is to be appreciated and understood that siding panels 21 can vary in configuration, and consequently, the present invention contemplates that indentations 11*a* are configured to mate with any configuration of siding panels 21. It is to be further appreciated and understood that exposed lower portion 20*a* of wall 20 can vary in configuration, and consequently, the present invention contemplates that abutment 11*b* is configured to be flushed against any configuration of exposed lower portion 20*a* of wall 20. The present invention further contemplates that the actual number of indentations 11*a* is equal to (as shown in FIG. 2) or less than the number of siding panels 21 affixed to wall 20 depending of the height of the wall panel to be mounted on siding panels 21, and that abutment 11*b* can partially extend (as shown in FIG. 2) or fully extend along the length of exposed lower portion 20*a* of wall 20.

Still referring to FIG. 2, the present invention also contemplates that wall panel mount 10 can be affixed to siding panels 21 by caulking indentations 11*a* to siding panels 21, and/or by screwing wall panel mount 10 to wall 20. It is to be appreciated and understood that the mating of indentations 11*a* to siding panels 21 and the flushed contact of abutment 11*b* to exposed lower portion 20*a* of wall 20 enables a wall panel to be stably mounted on siding panels 21 by adjoining the wall panel to third side surface 13. For purposes of the present invention, the term adjoining is broadly defined as the integration, permanent affixation or detachable coupling of the wall panel to third side surface 13. It is to be further appreciated and understood that the mating of indentations 11*a* to siding panels 21 and the flushed contact of abutment 11*b* to exposed lower portion 20*a* of wall 20 provides an aesthetic appearance to a wall panel mounted on siding panels 21.

Figure 3A:
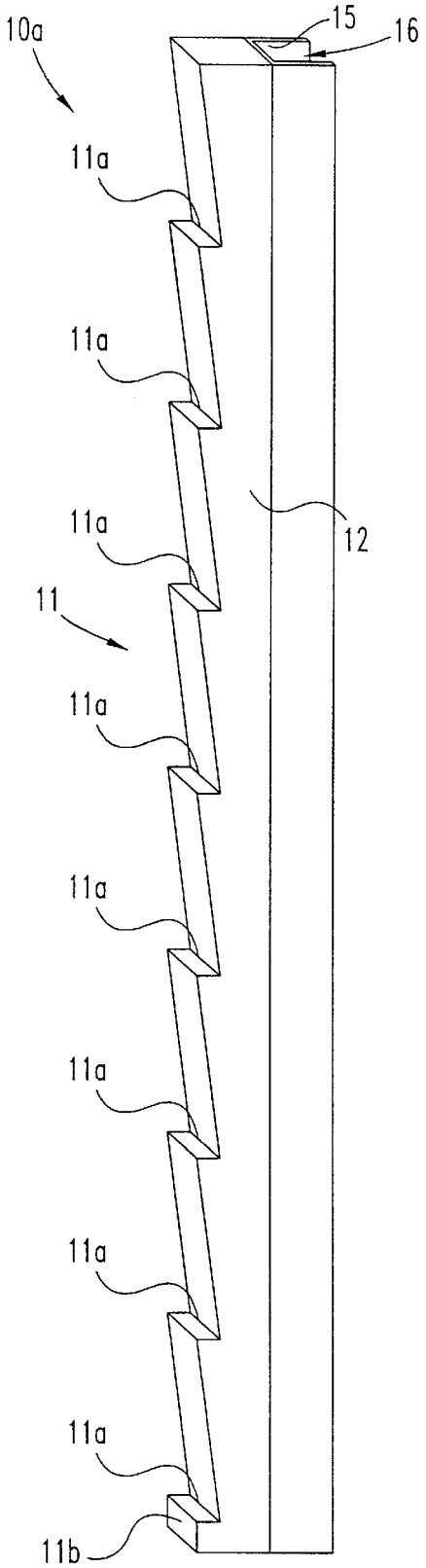
FIG. 3A is a front perspective view of an alternative embodiment of the wall panel mount of FIG. 1A in accordance with the present invention.
Figure 3B:
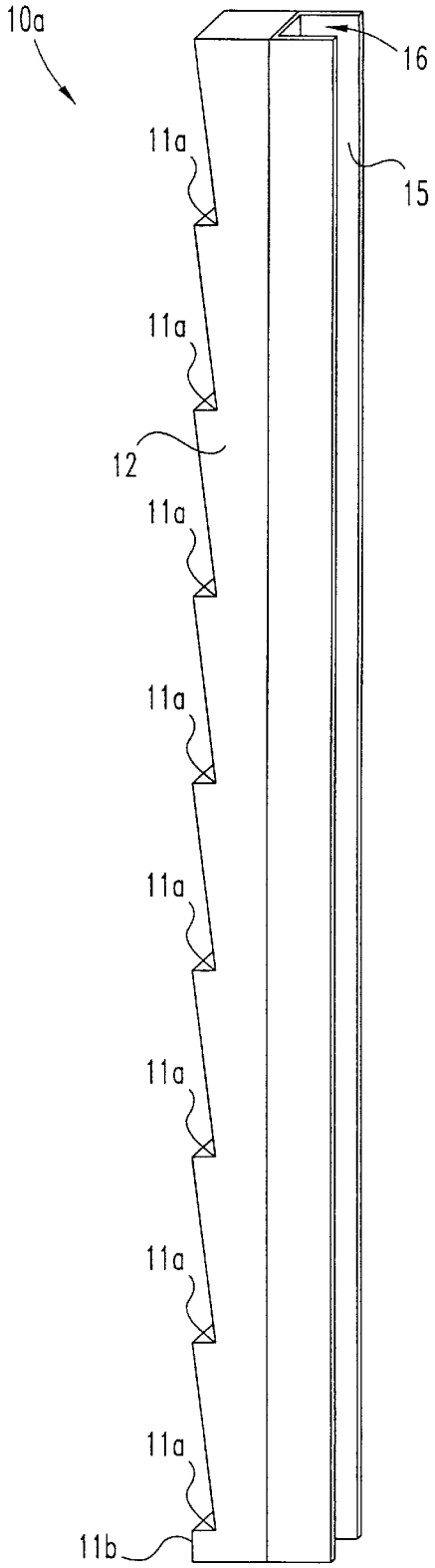
FIG. 3B is a rear perspective view of the wall panel mount of FIG. 3A.

FIGS. 3A and 3B are a front perspective view and a rear perspective view, respectively, of a wall panel mount 10*a* in accordance with the present invention. Referring to FIGS. 3A and 3B, wall panel mount 10*a*, like wall panel mount 10, is also substantially a square prism comprising first side surface 11, second side surface 12, third side surface 13 and fourth side surface 14. Wall panel mount 10*a* further comprises a U-shaped channel 15 having a groove 16 and adjoined to third side surface 13. For purposes of the present invention, the term adjoined is broadly defined as the integration, permanent affixation or detachable coupling of channel 15 to third side surface 13. The present invention contemplates that wall panel mount 10*a* can be made from any material, or any combination of materials. The present invention further contemplates that, as shown with wall panel mount 10 in FIG. 2, indentations 11*a* of wall panel mount 10*a* can be caulked to siding panels 21 and/or wall panel mount 10*a* can be screwed into wall 20. It is to be appreciated and understood that a wall panel can be stably mounted to siding panels 21 by securely inserting the wall panel into groove 16.

Figure 4A:
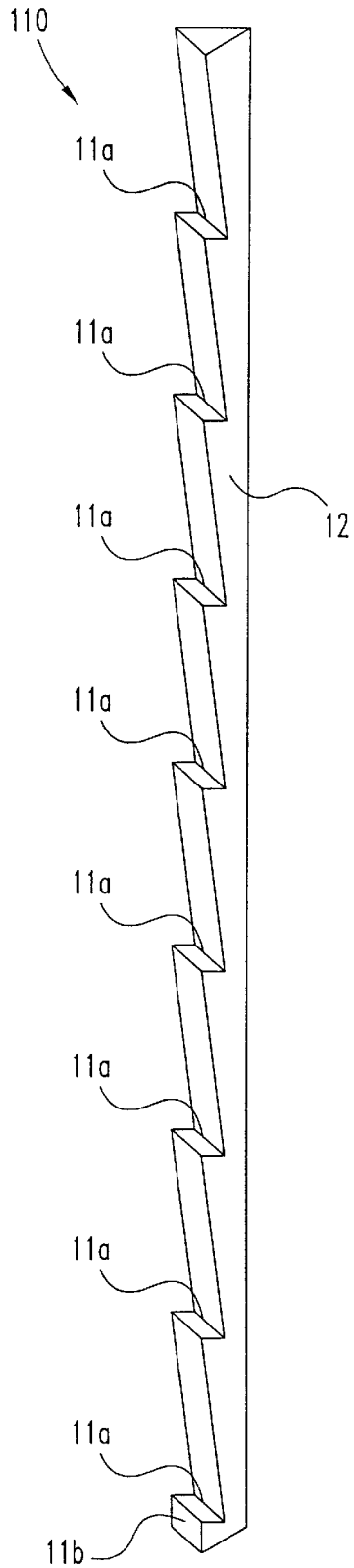
FIG. 4A is a front perspective view of a second preferred embodiment of a wall panel mouncordance with the present invention.
Figure 4B:
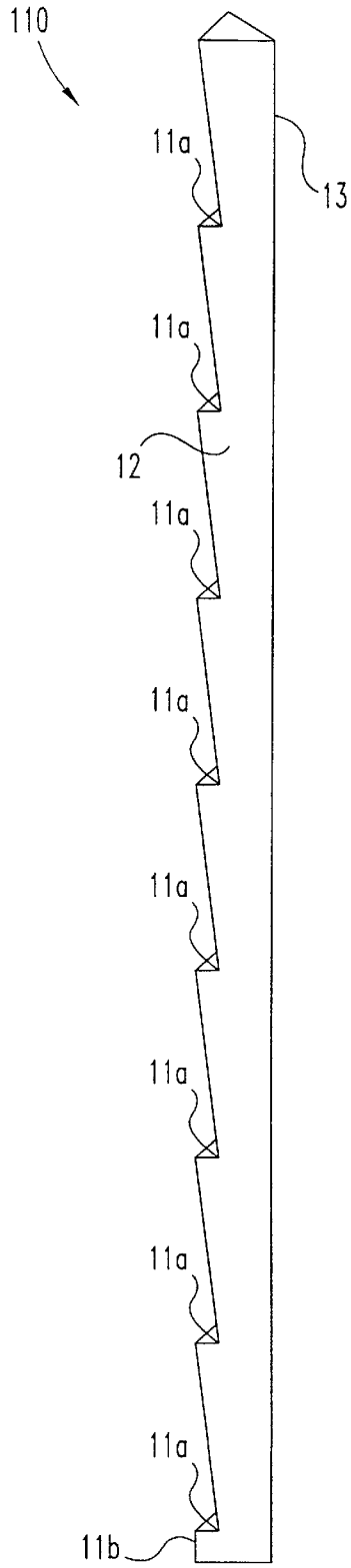
FIG. 4B is a rear perspective view of the wall panel mount of FIG. 4A.

FIGS. 4A and 4B are a front perspective view and a rear perspective view, respectively, of a wall panel mount 110 in accordance with the present invention. Referring to FIGS. 4A and 4B, wall panel mount 110 is substantially a triangular prism comprising first side surface 11, second side surface 12 bordering first side surface 11, and third side surface 13 bordering first side surface 11 and second side surface 12. The present invention contemplates that wall panel mount 110 can be made from any material, or any combination of materials. The present invention further contemplates that, as shown with wall panel mount 10 in FIG. 2, indentations 11*a* of wall panel mount 110 can be caulked to siding panels 21 and/or wall panel mount 110 can be screwed into wall 20. It is to be appreciated and understood, as shown with wall panel mount 10 in FIG. 2, that the mating of indentations 11*a* to siding panels 21 and the flushed contact of abutment 11*b* to exposed lower portion 20*a* of wall 20 enables a wall panel to be stably mounted on siding panels 21 by adjoining the wall panel to third side surface 13. For purposes of the present invention, the term adjoining is broadly defined as the integration, permanent affixation or detachable coupling of the wall panel to third side surface 13. It is to be further appreciated and understood that the mating of indentations 11*a* to siding panels 21 and the flushed contact of abutment 11*b* to exposed lower portion 20*a* of wall 20 provides an aesthetic appearance to a wall panel mounted on siding panels 21.

Figure 5A:
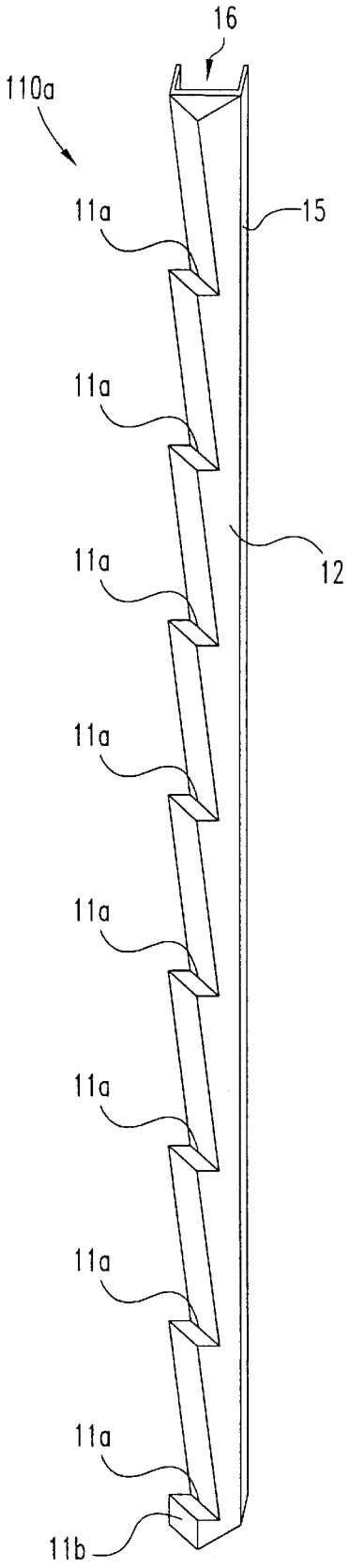
FIG. 5A is a front perspective view of an alternative embodiment of the wall panel mount of FIG. 4A in accordance with the present invention.
Figure 5B:
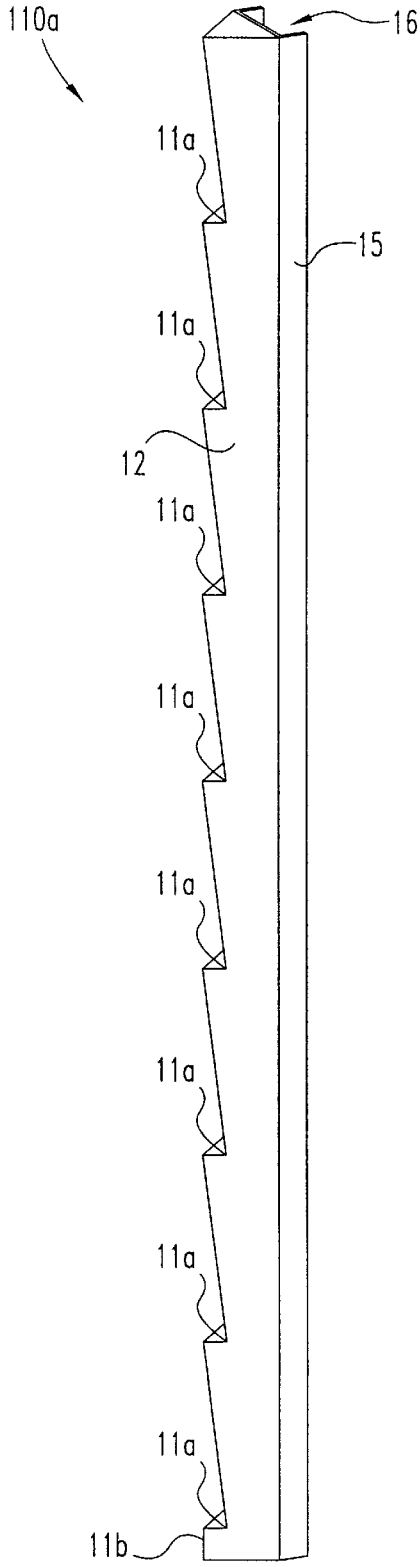
FIG. 5B is a rear perspective view of the wall panel mount of FIG. 5A.

FIGS. 5A and 5B are a front perspective view and a rear perspective view, respectively, of a wall panel mount 110*a* in accordance with the present invention. Referring to FIGS. 5A and 5B, wall panel mount 110*a*, like wall panel mount 110, is also substantially a triangular prism comprising first side surface 11, second side surface 12, and third side surface 13. Wall panel mount 110*a* further includes U-shaped channel 15 adjoined to third side surface 13. For purposes of the present invention, the term adjoined is broadly defined as the integration, permanent affixation or detachable coupling of channel 15 to third side surface 13. The present invention contemplates that wall panel mount 110*a* can be made from any material, or any combination of materials. The present invention further contemplates that, as shown with wall panel mount 10 in FIG. 2, indentations 11*a* of wall panel mount 110*a* can be caulked to siding panels 21 and/or wall panel mount 110*a* can be screwed into wall 20. It is to be appreciated and understood that a wall panel can be stably mounted to siding panels 21 by securely inserting the wall panel into groove 16.

While the present invention has been illustrated and described in detail in the drawings and foregoing description, the same is to be considered as illustrative and not restrictive in character, it being understood that the preferred embodiments have been shown and described and that all changes and modifications that come within the spirit of the present invention are desired to be protected.

What is claimed is:

1. In combination, a plurality of siding panels affixed to and vertically aligned along a wall of a building, a first siding panel being a bottom siding panel of said plurality of siding panel, a second siding panel being a top siding panel of said plurality of siding panels;

a wall panel mount comprising:

a first side surface;

a second side surface bordering said first side surface; and a third side surface bordering said second side surface, said third side surface affixed to at least one siding panel of said plurality of siding panels, wherein said third side surface includes a first indentation mated with said first siding panel;

a channel adjoined to said third surface of said wall panel mount, said channel having a groove; and a wall panel disposed within said groove of said channel whereby said wall panel is thereby mounted to said plurality of siding panels.

2. The combination of claim 1 wherein said third side surface borders said first side surface.

3. The combination of claim 2 wherein said first side surface, said second side surface, and said third side surface are oriented and dimensioned to constitute a triangular prism.

4. The combination of claim 1 further comprising a fourth side surface bordering said first side surface and said third side surface.

5. The combination of claim 4 wherein said first side surface, said second side surface, said third side surface, and said fourth side surface are oriented and dimensioned to constitute a rectangular prism.

6. The combination of claim 1 wherein said third side surface further includes a second indentation mated with said second siding panel.

7. In combination, a wall having a first portion and a second portion below said first portion;

a plurality of siding panels affixed to and vertically aligned along said first portion of a wall;

a wall panel mount comprising:

a first side surface;

a second side surface bordering said first side surface; and a third side surface bordering said second side surface, said third side surface affixed to at least one siding panel of said plurality of siding panels, wherein said third side surface includes an abutment flushed against said second portion of said wall; and a channel adjoined to said first side surface of said wall panel mount, said channel having a groove; and a wall panel disposed with said groove of said channel whereby said wall panel is thereby mounted to said plurality of siding panels.

8. The combination of claim 7 wherein said third side surface borders said first side surface.

9. The combination of claim 8 wherein said first side surface, said second side surface, and said third side surface are oriented and dimensioned to constitute a triangular prism.

10. The combination of claim 7 further comprising a fourth side surface bordering said first side surface and said third side surface.

11. The combination of claim 10 wherein said first side surface, said second side surface, said third side surface, and said fourth side surface are oriented and dimensioned to constitute a rectangular prism.

12. The combination of claim 7 wherein said third side surface further includes a first indentation mated with a first siding panel of said plurality of siding panels.

13. A structure, comprising:

a wall;

a plurality of lapped siding panels affixed to said wall;

a wall panel mount having a side surface affixed to at least one of said siding panels, said side surface having a plurality of indentations constructed and arranged to mate with said siding panels; and a wall panel adjoined to and extending away from said wall panel mount, wherein said wall panel mount has a channel defined therein and a portion of said wall panel is disposed in said channel.

14. The structure of claim 13, wherein said side surface is affixed to said at least one of said siding panels with caulk.

15. The structure of claim 13, further comprising a screw that affixes said wall panel mount to said at least one of said siding panels.

16. The structure of claim 13, wherein said wall panel mount is solid.

17. The structure of claim 13, wherein said wall panel mount is a single piece.

18. The structure of claim 13, wherein said siding panels are separate pieces.

19. The structure of claim 13, wherein said wall has an exposed portion that is unsided and said wall panel mount has an abutinent that contacts said exposed portion.

20. The structure of claim 13, wherein said wall panel mount has a rectangular cross-sectional shape.

* * * * *